US005199415A

United States Patent [19]

Johnson, Jr.

[11] Patent Number: 5,199,415

[45] Date of Patent: Apr. 6, 1993

[54] ADJUSTABLE FIREPLACE HEARTH SHIELD ASSEMBLY

[76] Inventor: Marvin B. Johnson, Jr., 25 Magnolia Dr., Newnan, Ga. 30263

[21] Appl. No.: 904,132

[22] Filed: Jun. 25, 1992

[51] Int. Cl.[5] ..... F24B 1/18

[52] U.S. Cl. ..... 126/500; 52/288; 108/27

[58] Field of Search ..... 126/500; 5/100, 512, 5/493, 424; 52/3, 515, DIG. 13, 288; 108/27

[56] References Cited

U.S. PATENT DOCUMENTS 3,260,257 7/1966 Mason ..... 126/500

4,787,366 11/1988 Bell ..... 126/500

4,903,686 2/1990 Jennings ..... 126/500

5,050,583 9/1991 Chapek et al. ..... 126/500

5,058,566 10/1991 Dabbs et al. ..... 126/500

*Primary Examiner*—Larry Jones

*Attorney, Agent, or Firm*—J. Gibson Semmes

[57] ABSTRACT

An adjustable fireplace hearth shield characterized by a frame which by extension and/or retraction is compressed upon the hearth outline, above the surface of the floor. Major and minor tightening adjustments may be effected while the frame is closely applied to the hearth. Simplicity of construction and/or on-site assembly distinguish the invention.

3 Claims, 2 Drawing Sheets

ADJUSTABLE FIREPLACE HEARTH SHIELD ASSEMBLY

BACKGROUND OF THE INVENTION

The hearth shield of this invention is adapted to prevent serious injury to small children, infants and invalids who may inadvertently run into or fall against the sharp and rugged edges of fireplace hearths such as are elevated from the floor. Most fireplace hearths are provided with slate and/or stone caps, having sharp edges, and these present a potential for sever head, facial and other injuries to persons, especially children, and so it is to protect these youngsters that the present invention is directed. In this invention, specific attention has been directed to facilitate installation and removal of the assembly, to simplicity of construction and economy in manufacture of the device, especially its structural frame. Additionally, all assembly units manufactured hereunder are adapted to accommodate adjustable and extension for handy assembly to hearths of varying external dimension. The shield construction is such that there exist exteriorly no sharp or abrasive projections such as screws, staples, fasteners, etc., nor are there any protruding screw heads, fastener caps, staples, frame parts of the like. All points of contact of the device are either rounded or padded to preclude damage to hearth construction with which the unit comes into contact.

The present hearth shield assembly accordingly provides a means for adjustably setting and fixing a hearth guard upon the hearth in such a way that is may initially be fitted to the hearth by means of a coactive relationship between overlapping interfitted frame angles, the tightening rod and angle, the angle assembly being adjustably refined by a tightening screw, adjacent a turn buckle located at one and of the tightening rod, as hereinafter described.

THE PRIOR ART

| INVENTOR | DATE | PATENT NO. | TITLE |
|---|---|---|---|
| Mole (G.B.) | 1955 | 727,244 | IMPROVEMENTS IN OR RELATING TO GUARDS FOR FIRES |
| Scherer | 1968 | 3,378,003 | FIREPLACE SCREEN |
| Jennings | 1990 | 4,903,686 | OUTER HEARTH PAD |
| King | 1990 | 4,922,891 | HEARTH CONCUSSION BARRIER |
| Chapek, et al | 1991 | 5,050583 | DEVICE FOR PROTECTIVELY COVERING HEARTHS |
| Dabbs, et al | 1991 | 5,058,566 | FIREPLACE HEARTH PAD SYSTEM |

From an examination of the aforementioned prior art it will be appreciated that the distinctions in invention hereunder are evident from a close examination of the ensuing description, drawings and claims. More specifically, the simplicity of construction, assembly and installation upon hearths of varying size, highlight the invention in its distinctive characteristics.

SUMMARY OF INVENTION

The invention, in its broadest form, provides a means for adjustably setting a fireplace hearth guard or shield upon hearths of varying dimension in such a way that the hearth guard may be initially fitted to the hearth by means of coactive interrelationship between a tightening rod on one frame angle and another angle of the frame. Tightening upon the hearth is refined by an adjustable tightening screw which is located at one end of the tightening rod, per se. Among the advantages achieved through the adaptation of the present invention are the following: The device has a universality such as may permit installation on a majority of elevated standard fireplace hearths. It is simple in construction, such that installation may be effected without uniquely designed tools. In addition to the aforesaid, the device is inconspicuous and attractive; it is safe in that no protrusions are presented to persons, especially infants, nor is it removable by either infant or adults without an especial knowledgeable effort.

DESCRIPTION OF PREFERRED EMBODIMENTS

Figure 1:
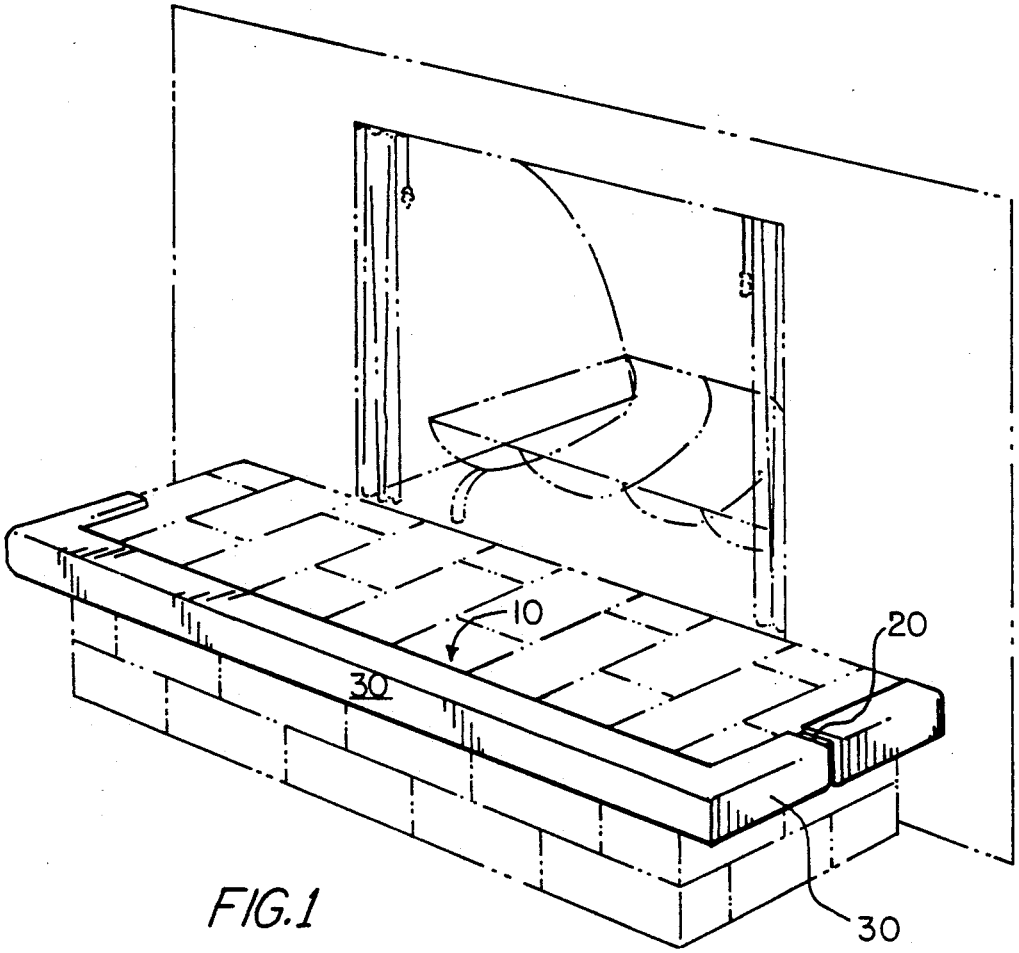
FIG. 1 is a view in perspective of invention showing the mode of adaptation of the invention to an existing, elevated fireplace hearth. The fireplace and hearth are depicted in phantom.

The adjustable hearth shield 10 is provided with extruded foam cushioning 30 which is adapted to adhere to the frame 20. The cushioning has zero burn, self extinguishing qualities and before installation is provided with an industrial grade, pressure sensitive adhesive on its interior. The cushioning adhesive is protected by a removal tape placed upon the overlapping elements forming the angled tracks 22-22', hereinafter defined. The frame itself, when assembled, represents in top plan, a U-shaped unit, the stub ends of 24-24' of which are fixed to ends of the frame tracks. In final installation, these stub ends will clamp the frame firmly against the hearth, a particular friction pad 40 being removeably stuck to each extension of the frame's stub end. See FIGS. 1 and 2. Significantly, the stub ends of the frame 20 as defined by the angle extensions 24-24', relative to tracks 22-22' are set at less than a 90 degree angle, such that when installed and properly tightened the tacky treated felt strip 40 secures against the sides of the hearth when the tightening bolt is activated, to pull the respective sides of the frame together. For facility of installation and removal, one need simply have access to the threaded screw at the end of the tightening rod, a preliminary turnbuckle tightening having been effected to interlock respective overlapping portions 22-22' of the frame.

Figure 2:
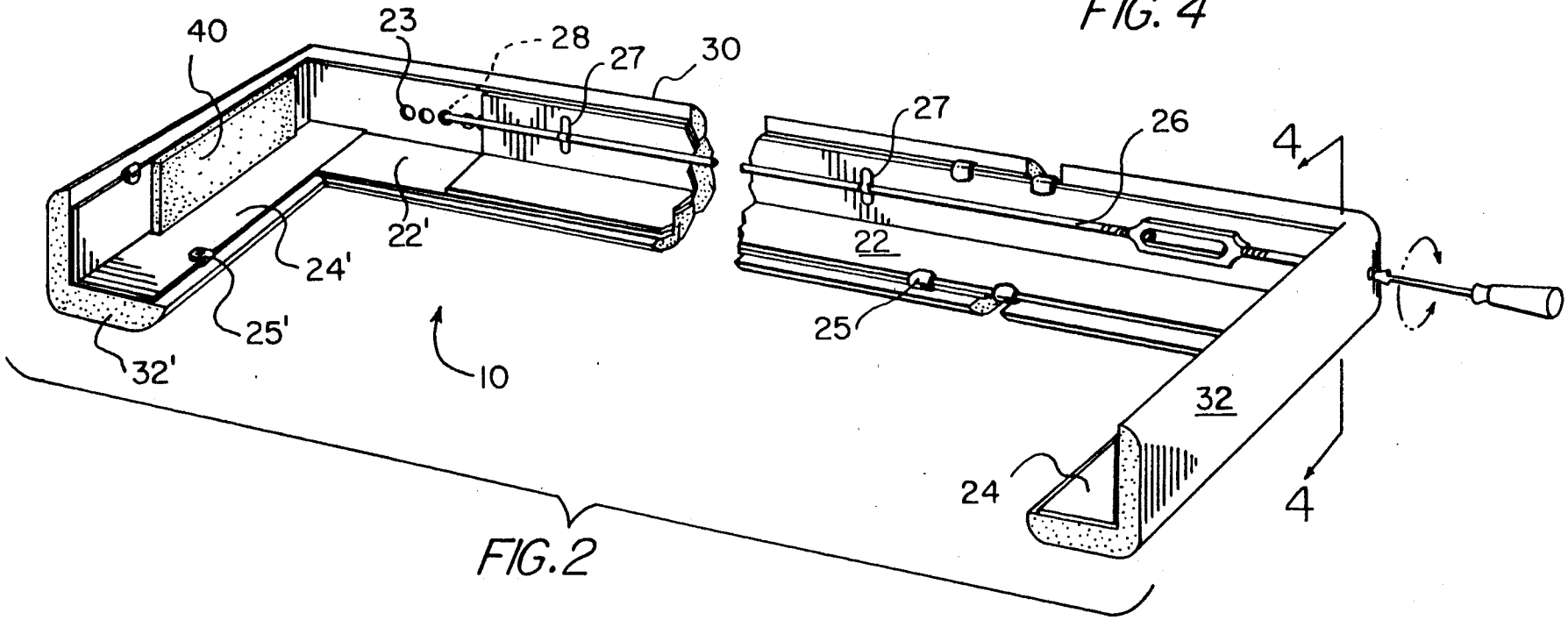
FIG. 2 is an inverted rear view of invention in perspective according to FIG. 1.

When viewed from the rear, as in FIG. 2, it will appear that the inverted frame 20 comprises essentially elongated and righthand and lefthand angles 22-22', the latter being slideably adjustable, relative to the former. See FIG. 2. The righthand side 22 of frame bears guides to slideably secure transversely disposed adjustment rod 26, this rod being held in position by appropriate anchors 27. Guides are fixed to the depending extension of frame element 22. Rod 26 being adjustably fixed at one end of the right side of the frame angle 24, extends beyond the lefthand limit of this element 22 of the frame to overlap element 22'. The rod 26 has a turn buckle interposed between its threaded connections. A counterpart of the lefthand side of the frame 20 is represented by anchor holes 23 into which an outwardly diverted hitching hook 28 (not shown) of the adjustment rod 26 may be fixed. Thus is permitted fine tuned locking by extension and retraction as between respective left and right stub ends of the frame. These stub ends 24-24' are forced into compressive registry with sidewalls of the hearth. The tightening rod unit engaging the stub end 24 is an integral part of the tightening rod and used for fine tuning, reference FIG. 2. To iterate, the tightening rod 26 and turn buckle 26' are secured under the righthand side 22 of the frame 20, whereby the rod may protrude past the inside end of the lefthand frame element 22' so that the hook of the rod may be anchored into one of the many adjustment holes 23' of the lefthand frame element 22'. Thus, when the entire unit is placed on the hearth, the foam padding 30 having been secured to the exterior of the frame and appropriate adjustment holes selected for purposes of inserting the hook of the tightening rod, there simply remains the tightening of the tightening rod turn buckle. When this function has been performed a portion of the filler cushion strip 40 for the right side of the frame may be secured by cutting to appropriate length, peeling off the back of the pressure sensitive adhesive tape, not shown, and bonding to a previously unpadded segment of right side of frame.

Figure 3:
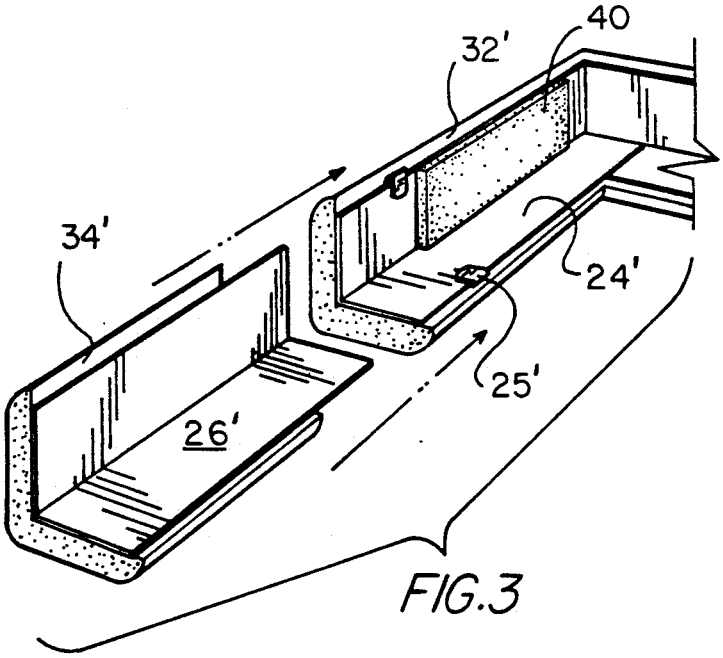
FIG. 3 illustrates also an inverted rear view of invention in part, the view illustrating adaptability of the assembly to hearths of variable depth.
Figure 4:
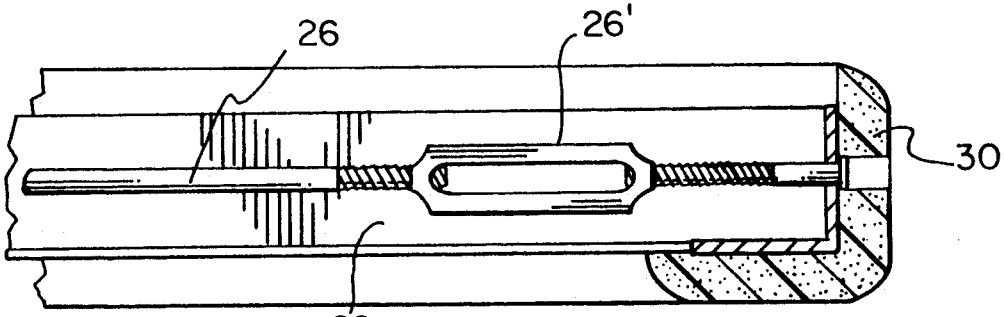
FIG. 4 is partial vertical section view of invention taken along lines 4—4 of FIG. 2.

Whereas the depth of the unit is such as to accommodate a hearth having essentially an eight inch deep brick extension, this unit may be further extended in depth by adapting a corresponding angle to the stub end of the frame, after removal of the felt strip 40. A receiver slip 25' is provided for this purpose. See FIG. 3 showing a portion of inverted lefthand assembly. Thereafter, one may replace the tacky felt element 40 and cut an extended exterior pad 30 to appropriate length. After peeling off the adhesive covering, the unit is available for a hearth of extended depth.

Among the more desirable features of the hearth guard is that is may be shipped essentially preassembled, such that upon installation the user removes one piece of masking tape, extending the joined frame units 22-22' to appropriate hearth width. Thereafter, the tightening rod hook 28 extends to the nearest adjustment hole 23 and the entire unit is placed onto the hearth. At this juncture, the access hole through the frame and padding permits fine tightening of the tightening rod bolt and as the padding 40 has then been bonded to the frame, nothing further is required excepting the application of padding to the stub ends. See FIG. 2.

INSTALLATION AND ASSEMBLY

A) Remove all masking tape. CAUTION: do not remove adhesive backing on filler pad 40 until later.

B) With tightening rod hook 28 turned so as not to grab adjustment hole 23, extend sections 22-22' so that frame will just barely fit on hearth. Turn unit enough to allow access to rod 26. Turn rod so hook can be pushed into nearest hole. Pull sections apart just enough to secure hook. Place unit on hearth. Insert screwdriver in plugged hole at right corner. Turn tightening bolt clockwise until tension is felt. Now, tap edges lightly to be sure unit is in place. Tighten further with screwdriver until unit is firmly secure.

C) Measure filler pad 40 ¼" longer than space and mark small dot at corner. Place a prepared support block under pad 40 with round edges at top directly below mark. Place plastic cap next to mark and carefully cut one side at a time using a very sharp knife.

D) Slide moveable a shim to within ⅛" of left pad.

E) Try fitting filler pad 40 in place before removing adhesive backing. Now, carefully peel off adhesive backing. Bend filler pad outward slightly. Start at one end keeping "V" of pad aligned with corner of frame as you allow pad to contact frame until fully in place.

F) Installation is now complete. You may remove and reinstall in just a few seconds as often as desired by means of the tightening bolt at right corner.

Whereas the invention has been defined with reference to the apparatus depicted in the specification and drawings, various modifications thereto may be undertaken without departing from the spirit of the ensuing claims.

I claim:

1. An adjustable fireplace hearth shield assembly having a substantially rigid and laterally adjustable frame member, comprising:

a) laterally extendible and retractable, interfitting righthand and lefthand frame tracks, said tracks defining angle extensions of L-shaped vertical cross-section, the righthand track overlapping in part the lefthand track adjacent the interior of the frame member, the lefthand track having plural anchor apertures in elongated gradient array, b) the righthand track bearing on its interior an extendible-retractable tightening rod which overlaps the lefthand track for engagement with a preselected aperture of said lefthand track;

c) each of said frame tracks bearing rearwardly directed righthand and lefthand side tracks thereon at an angle of less than 90 degrees from said frame tracks;

d) replaceable exterior foam padding attached to the exterior of respective frame and side tracks, comprising a dense foam with adhesive means interiorly thereon, adhering to the exterior of all said tracks.

2. The adjustable fireplace hearth shield assembly of claim 1 wherein the tightening rod is slideably secured at an anchor end to the righthand side track and extends therebeyond, to seat in the lefthand track by hook means at a free end of the tightening rod.

3. The apparatus according to claim 2 further including at least one elongated friction-fitting hearth filler cushion, which is fixed to the interior of a stub end side track.

* * * * *